United States Patent [19]

Schaiewitz

[11] Patent Number: 4,741,493

[45] Date of Patent: May 3, 1988

[54] LOCKING SYSTEM FOR SPOOLS HOLDING DISPLAY CHAINS

[76] Inventor: Daniel Schaiewitz, 87 Slocum Ave., Bronxville, N.Y. 10708

[21] Appl. No.: 879,097

[22] Filed: Jun. 26, 1986

[51] Int. Cl.[4] ..... B65H 49/00

[52] U.S. Cl. ..... 242/129.8; 242/129.6

[58] Field of Search ..... 242/129.5, 129.6, 129.7, 242/129.8, 85; 242/99, 100

[56] References Cited

U.S. PATENT DOCUMENTS

| | | | |
|---|---|---|---|
| 909,559 | 1/1909 | Danker | 242/129.6 |
| 1,403,123 | 1/1922 | Leedy | 242/129.6 |
| 1,610,753 | 12/1926 | Davis | 242/129.6 |
| 1,674,877 | 6/1928 | Tufte | 242/100 |
| 2,551,149 | 5/1951 | McCampbell | 242/100 X |
| 2,583,491 | 1/1952 | Orlando | 242/99 X |
| 2,600,049 | 6/1952 | Crider | 242/99 |
| 2,705,114 | 3/1955 | Worsham | 242/86.5 R |
| 2,776,644 | 1/1957 | Fontaine | 242/99 X |
| 2,841,343 | 7/1958 | Dorman | 242/129.6 |
| 3,168,995 | 2/1965 | Osterman | 242/129.8 |
| 3,907,229 | 9/1975 | Iannucci | 242/129.8 |
| 4,564,152 | 1/1986 | Herriage | 242/86.5 R |

FOREIGN PATENT DOCUMENTS

| | | | |
|---|---|---|---|
| 271277 | 5/1927 | United Kingdom | 242/129.8 |

*Primary Examiner*—Stuart S. Levy

*Assistant Examiner*—Katherine Matecki

*Attorney, Agent, or Firm*—Lackenbach, Siegel, Marzullo & Aronson

[57] ABSTRACT

A pilfer-proof system for locking spools holding chains of valuable material displayed in a case which includes the spool having a cylindrical portion having an axial hole and opposed radially extending rims connected to the cylindrical portion with the chain spooled around the cylindrical portion, a pivot extending through the axial hole and mounted to side walls of the case, and a locking member adapted to hold the spools in a frictional locked mode upon the action of the salesman until released from the locked mode by the salesman. The locking member can be a cylindrical locking member rotatably mounted to a semicylindrical bracket at one of the walls and having an axial pocket having internal threads adapted to mate with external threads at the end of the pivot. When the locking member is screwed onto the pivot, a pressure ring at the end of the locking member presses against the near rim of the near spool which in turn presses the following spools against another pressure ring near the other wall. The locking member can be a bar over the spools provided with frictional mechanism adapted to prevent unspooling of the chain. The locking member can also be a screw threaded through one wall capable of being screwed against the rim of a spool so as to create a friction lock against a pressure ring at the other wall.

8 Claims, 2 Drawing Sheets

LOCKING SYSTEM FOR SPOOLS HOLDING DISPLAY CHAINS

This application relates generally to preventing valuable chains being displayed on spools from being pilfered and more particularly to a system for locking the spools into a nonrotational mode so that the chains cannot be unreeled from the spools.

BACKGROUND OF THE INVENTION

Valuable chains made of valuable material such as gold or silver being displayed for sale to customers are best designed for maximum visual appeal when the chains can be handled by customers. Because the chains are so valuable, however, experience has shown that on occasion a chain is unreeled from a spool and stolen. A spooled chain display that can be touched by a customer while at the same time being pilfer proof in the sense that the customer touching the chains cannot unspool any of the chains in the display can be very advantageous for a retailer.

SUMMARY OF THE INVENTION

Accordingly, it is an object of the present invention to provide a pilfer-proof system for spools holding display chains made of precious metals that are mounted in a merchandiser case.

It is a further object of the present invention to provide a spool locking system for display chains that can be easily placed into and released from a locked, nonspooling mode by a salesperson so that the chain can only be unspooled by the customer by the unlocking action of a salesperson.

It is still another object of the present invention to provide a spool locking system for display chains in a merchandiser display case that encourages touching by the customer while at the same time being maintained in a locked mode capable of being easily unlocked by the salesperson.

In accordance with the above objects, a system for locking spools for chains on display is provided. The system includes at least one spool member that has a spool cylinder that in turn forms a cylindrical axial spool hole and a pair of radially extending rims connected to the spool cylinder; an elongated chain spooled around the spool cylinder between the two rims; an elongated pivot having opposed first and second ends and extending through the spool hole, the spool being rotatable about the pivot; first and second supports, such as the opposed side walls of a display case, that are adapted to support the pivot; and a locking device connected to the first support that is capable of moving the one spool member from a spooling mode to a nonspooling mode wherein the one spool member is held in a frictional locking relationship between the locking device and the second support, whereby the chain cannot be unspooled from the one spool member; the locking device being releasable from holding the one spool member in the nonspooling mode so that the one spool member is positioned in a nonfrictional, nonlocking relationship between the locking device and the second support, whereby the chain can be unspooled from the one spool member.

In the preferred embodiment the locking device includes a cylindrical locking member having opposed inner and outer axial ends, a first pressure member positioned between the inner axial end and the first pivot end of the pivot member, and a second pressure member positioned between the second pivot end and the second support, the locking device being rotatably connected at the outer axial end to the first support, the locking member being adapted to pressure the first pressure member against one rim of the spool member and the other rim member against the second pressure member when the system is moved to the nonspooling mode. The locking member forms an axial pocket at the inner end having internal threads and the pivot has external threads at the first pivot end, the pivot being threadably mounted in the pocket. The locking device further includes a gripping device adapted to prevent the pivot from rotating. The locking member is capable of being threaded onto the pivot toward the first pressure member and from the pivot away from the first pressure member. The locking member forms an axial keyway at the outer axial end. A locking tool has a handle portion and a key portion adapted to be received by the keyway. The locking tool is capable of being operated when positioned in the keyway to rotate the locking member so as to threadably and axially move the locking member onto or from the pivot so as to press the spool member into the nonspooling mode or release the spool member from the nonspooling mode. The first and second pressure members preferably are first and second rings mounted to the pivot.

Another embodiment of the invention includes a horizontal locking bar that is capable of extending through holes at the ends of the rims of the spools. The locking bar is supported by the first and second supports and can be inserted into or removed from a locking relationship with the spools.

Yet another embodiment includes a horizontal bar positioned over the spools and that can be raised or lowered so that a locking flange comes into contact with or is removed from contact with the rims of the spools. When in frictional contact with the spool rims, the locking flange prevents rotational movement of the spools. Optional tabs at the peripheries of the rims are adapted to come into blocking contact with the locking flange.

Another embodiment of the invention includes a locking device that has a cylindrical locking member having external threads rotatably mounted in an internally threaded set piece mounted in the first support wall. The locking member forms an axial recess having internal threads that are adapted to threadably receive the external threads of the end of the pivot. A first pressure ring exerts pressure against the rim of the nearest spool when the locking member is threaded inwardly so that the farthest spool is pressed against a second pressure ring situated near the second support so that the spools are locked in a nonspooling mode.

Another embodiment includes a horizontal bar having depending biasable clips that can be removably attached to adjoining rims of adjacent spools so as to prevent rotation of the spools.

Also, still another embodiment includes a horizontal screw extending through the first support. The screw is threadably mounted in the first support and can be threaded inwardly so as to press the tip of the screw against the rim of the nearest spool. This action results in that spool being pressed against the next spool and so on until the last spool is pressed against a pressure ring at the second support so that all the spools are frictionally engaged.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teachings herein, and such other embodiments or modifications are intended to be reserved especially as they fall within the scope and spirit of the subjoined claims.

BRIEF DESCRIPTION OF THE DRAWINGS

The invention will now be described with reference to the accompanying drawings, wherein.

DESCRIPTION OF THE PREFERRED EMBODIMENTS

Reference is now made in detail to the drawings wherein the same numerals refer to the same or similar elements.

Figure 1:
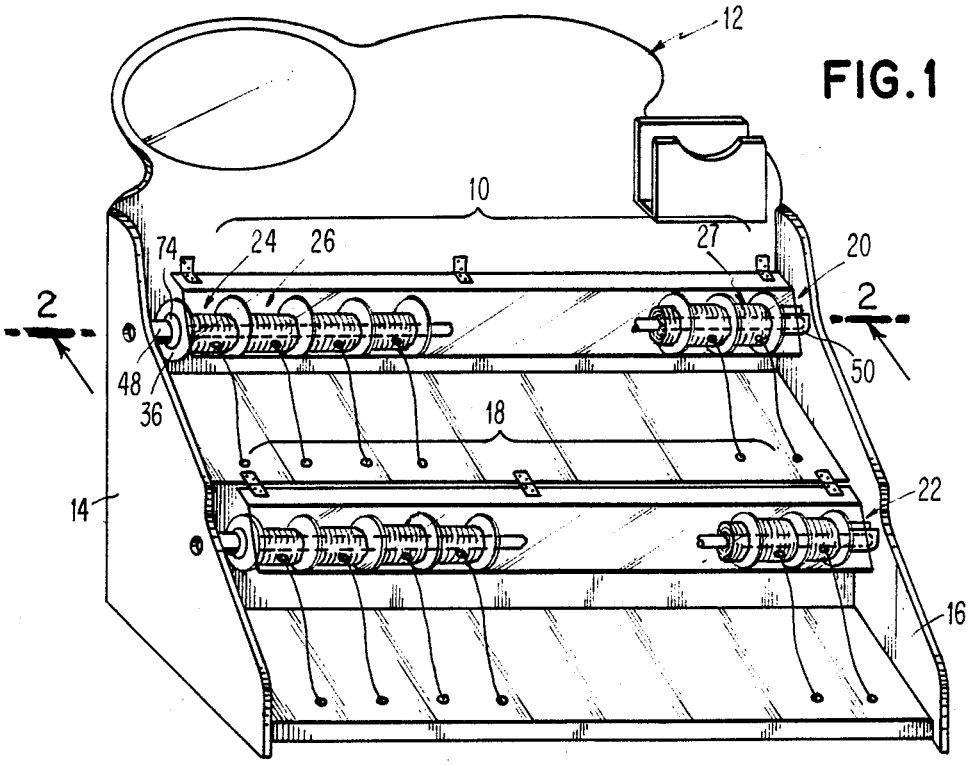
FIG. 1 is a perspective view of a merchandise display case having two rows of spools having chains made of valuable material.
Figure 2:
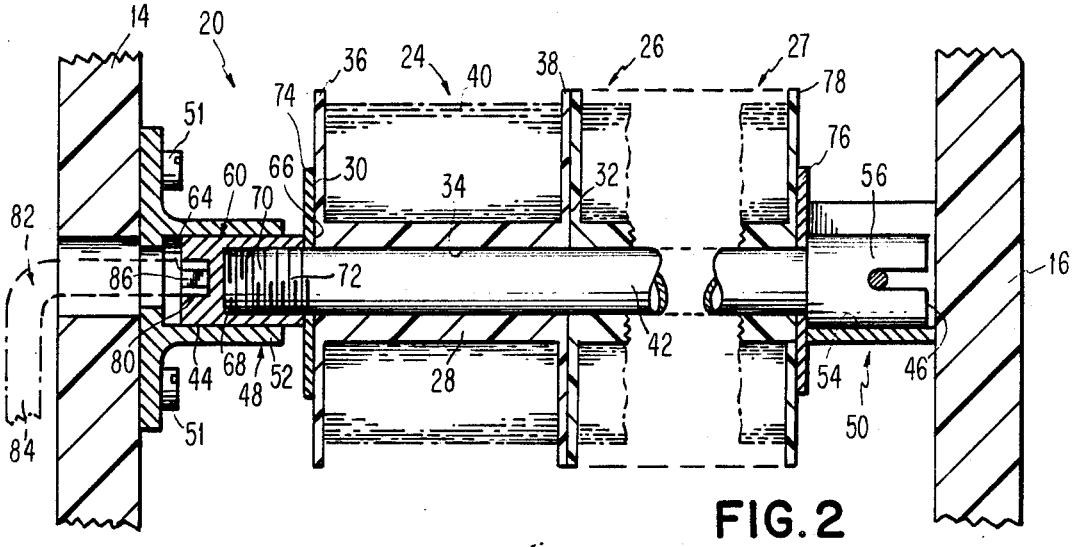
FIG. 2 is a section taken through plane 2—2 of FIG. 1.
Figure 3:
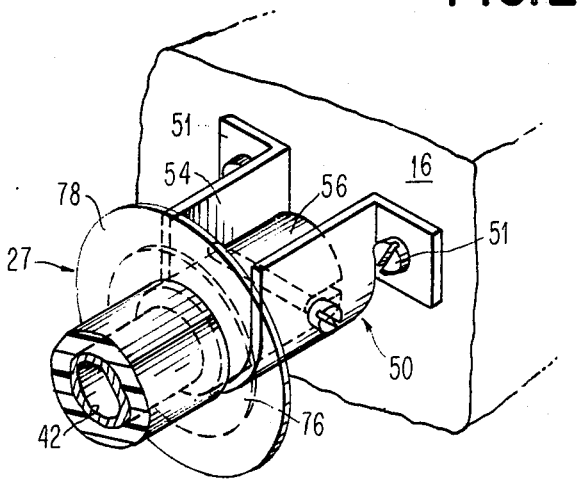
FIG. 3 is a perspective detail of one end of the pivot and the bracket holding the pivot.

A spool locking system 10, shown in perspective in FIG. 1 and in detail in FIGS. 2 and 3, is mounted in a display case 12 that includes a pair of spaced, vertical walls 14 and 16. A number of spools 18 are positioned in two horizontal upper and lower rows 20 and 22, respectively, between walls 14 and 16. A cross-section of the typical upper row 20 is shown in FIG. 2 wherein a spool 24 spaced from wall 14 is positioned adjoining a spool 26 is shown in partial view. A portion of another spool 27 is spaced from wall 16. Typical spool member 24 includes a cylindrical portion 28 having opposed inner and outer axial ends 30 and 32, respectively, and forming an axial hole 34 extending between the opposed axial ends. A pair of opposed radially extending inner and outer rims 36 and 38, respectively, relative to wall 14 are connected to the axial ends. An elongated chain 40 made of gold, silver, or other valuable material is spooled around cylindrical portion 28 between rims 36 and 38 of spool 24. Similar chains of the same or other material are spooled around the other spools 18.

An elongated, generally horizontal, cylindrical pivot 42 having opposed pivot ends 44 and 46 located proximate walls 14 and 16, respectively, extends through axial hole 34 so that spools 24, 26, and 27 are capable of being rotated around pivot 42. Ends 44 and 46 of pivot 42 extend slightly beyond rims 36 and 78.

A pair of opposed brackets 48 and 50 having mounting flanges are secured to the inner facing surfaces of wall 14 and 16, respectively, by suitable connectors such as bolts 51 extending through the mounting flanges into walls 14 and 16. Bracket 48 forms a horizontal cylindrical recess 52. Bracket 50 forms a horizontal semicylindrical recess 54 in which pivot end 46 is rotatably mounted, so that pivot 42 is rotatably supported at bracket 50. Pivot end 46 is shown as including a raised portion 56 having a diameter slightly greater than the diameter of pivot 42.

A crossbar 58 extends horizontally and diametrically across recess 54 of bracket 50, and pivot end 46 forms a diametrical slot 60 adapted to receive crossbar 58 so that pivot 42 cannot be rotated when crossbar 58 is positioned in slot 60.

A locking member 62 having opposed inner and outer axial ends 64 and 66, respectively, relative to wall 14 is received by and rotatably supported within cylindrical recess 52 of bracket 52. Locking member 62 forms an axial pocket 68 opening at outer axial end 66, which in turn forms internal threads 70. Pivot 42 forms external threads 72 at pivot end 44 that mate with internal threads 70 so that pivot end 44 is capable of being threadably mounted in axial pocket 68 of locking member 62. The outer diameter of locking member 62 and the outer diameter of raised portion 56 are equal so that pivot member 42 is horizontal.

A ring 74 mounted around pivot 42 is positioned between inner rim 36 of spool 24 and locking member 62. Also, another ring 76 mounted around pivot 42 is positioned between a rim 78 of last spool 27 and raised end portion 56. Alternatively, ring 74 may be integral with locking member 60 at outer axial end 66; and ring 76 may be integral with pivot 42 at the joint, or step, between the main pivot member 42 and raised portion 56.

Locking member 62 forms an axial keyway 80 at inner axial end 64. A locking tool 82, such as an Allen or hexagonal wrench, having a 90 degree bent handle 84 and a key portion 86 is adapted to be received by keyway 80. Wall 14 and bracket 48 have apertures through which key 86 can be passed to enter keyway 80. When crossbar 58 is positioned in slot 60, locking tool 82 is capable of being operated by a user when positioned in keyway 80 to rotate locking member 48 so as to threadably and axially move locking member 62 onto or from pivot 42. When locking member 48 is rotated so as to thread onto pivot 42, ring 74 is pressed against rim 36 of spool 24 and spool 24 is pressed against spool 26 and so on until last spool 27 is pressed against ring 76 at bracket 50. This action results in all the spools mounted to pivot 42 being held in a nonspooling mode in a frictional locking relationship between rings 74 and 76 so that chain 40 and the remaining spools cannot be unspooled. When locking member 62 is unthreaded from pivot 42 and moved away from the locked spools, the pressure exerted at rim 36 by ring 74 is removed with the result that all the spools can be rotated and their respective chains can be unspooled from the spools by a salesperson or a customer.

FIGS. 4, 5, 6, 7, and 8 illustrate other embodiments of the invention herein.

Figure 4:
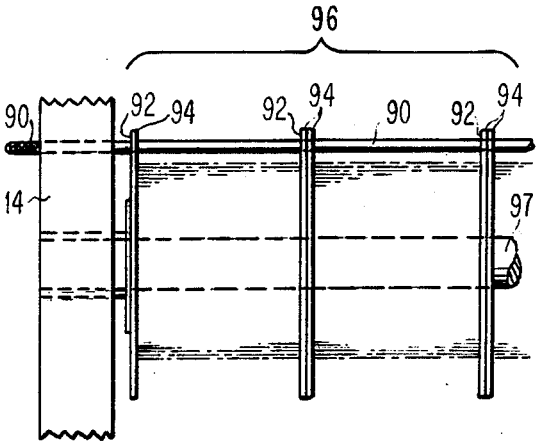
FIG. 4 is a view of another embodiment of the invention.

FIG. 4 illustrates a transverse locking rod 90 extending through the support walls 14 and 16 (not shown) through holes 92 at the edges of rims 94 of spools 96 rotatably mounted to pivot 97. Rod 90 is removable from walls 14 and 16 and rims 94 so as to free spools 96 at the option of the operator. In this embodiment there is no crossbar and slot as shown in FIG. 3 so that pivot 97 is free to rotate at all times.

Figure 5:
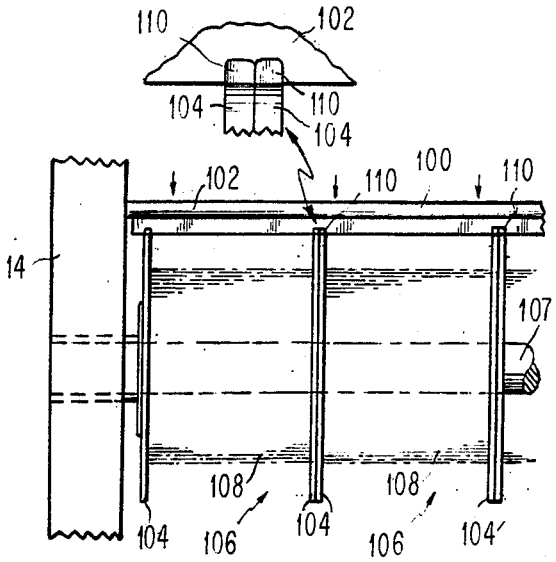
FIG. 5 is a view of another embodiment of the invention.

FIG. 5 illustrates a blocking bar 100 with a depending horizontal blocking flange 102 adapted to frictionally engage rims 104 of spools 106 rotatably mounted to a pivot 107 secured to support walls 14 and 16. Spools 106 hold chains 108. When blocking bar 100 is lowered as indicated by arrows, flange 102 frictionally engages rims 104 and prevents spools 106 from being rotated. Blocking bar 100 is slidably mounted to the inner surfaces of walls 14 and 16 (not shown) and can be entirely slid onto or from the walls as needed. Spools 106 are freed to rotate and the thread can be unspooled when bar 100 and flange 102 are lifted from frictional engagement with rims 104. Optional tabs 110 radially extend from at least one rim 104 of each spool 106 when the spools are rotated by the operator or a customer. In this embodiment there is no crossbar and slot as shown in FIG. 3, so that pivot 107 is free to rotate at all times.

Figure 6:
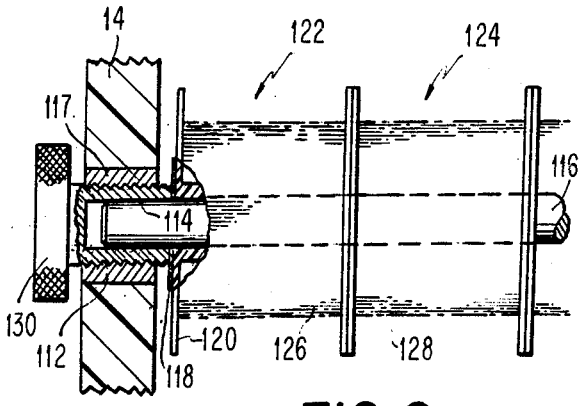
FIG. 6 is a view of another embodiment of the invention.

FIG. 6 shows a cylindrical locking member 112 having a horizontal cylindrical recess 114 in turn having internal threads threadably mounted to the inner end of a pivot 116. Locking member 112 is rotatably mounted in a set piece 117 non-rotatably mounted in wall 14. The opposite end of pivot 116 at wall 16 (not shown) is adapted to be locked into a non-rotatable mode at a crossbar and a slot the same as those shown in FIG. 3. Set piece 117 has a horizontal cylindrical hole adapted to receive cylindrical locking member 112 and forming internal threads with locking member 112 forming external threads adapted to mate with the threads of set piece 117. A ring 118 positioned at and optionally integral with the outer axial end of locking member 112 presses against the inner rim 120 of a spool 122 adjoining another spool 124 each holding chains 126 and 128, respectively. Other spools adjoin spool 124. A cylindrical handle 130 is axially joined to the outer end of locking member 112 external of wall 14. When handle 130 is rotated in one direction locking member 112 is threaded relative to set piece 117 and relative to pivot 116 towards rim 120 so that ring 118 presses against rim 120 with the result that spools 122, 124, and so on are pressed together until the rim of the last spool is pressed against the ring 76 proximate wall 16 so that each of the spools are locked in a non-rotatable position. On the other hand, when handle 130 is turned in the opposite direction, locking member 112 is threaded outwardly relative to set piece 117 and pivot 116 away from rim 120 so that the spools are freed to rotate and chains 126 and 128 can be unspooled.

Figure 7:
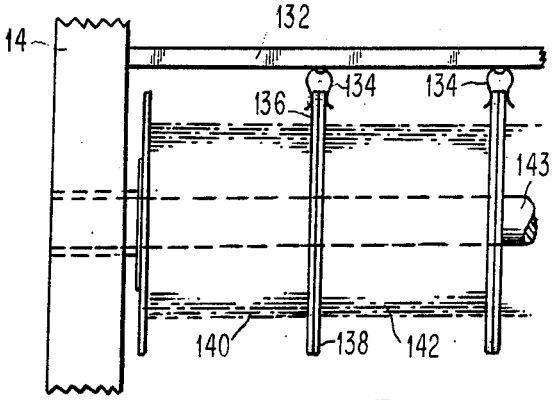
FIG. 7 is a view of another embodiment of the invention.

Another embodiment of the present invention is shown in FIG. 7 where a bar 132 horizontally mounted to the inner surfaces of support walls 14 and 16 holds depending biasable flared-mouth clips 134 capable of gripping adjoining rims 136 and 138 of adjoining spools 140 and 142, respectively, in a frictionally locked non-rotational position. The two clips are illustrative of the operation of a plurality of clips holding a plurality of spools. One clip can grip one rim of one spool in a frictionally locked relationship. Pivot 143, which is connected to walls 14 and 16, has no crossbar and slot locking arrangement at wall 16 as shown in FIG. 3. Bar 132 can be raised or lowered in tracks (not shown) at the inner surfaces of walls 14 and 16.

Figure 8:
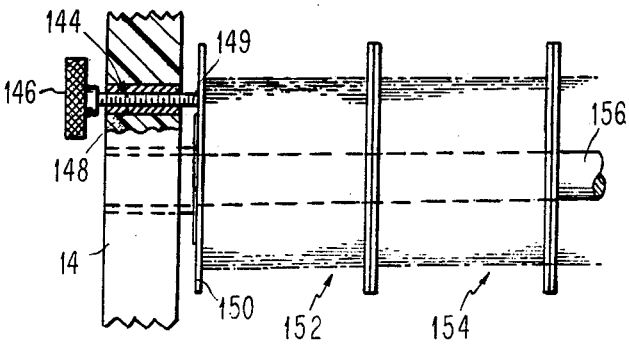
FIG. 8 is a view of another embodiment of the invention.

In FIG. 8 a horizontal screw 144 threadably mounted within a set piece 148 mounted in support wall 14 has a tip 145 at one end positioned past the inner surface of wall 14 and a handle 146 at the opposite end positioned external of wall 14. Spools 152 and 154, representative of spools in general holding chains, are rotatably mounted to a pivot 156 mounted between walls 14 and 16. When handle 146 is rotated so as to thread screw 144 inwardly, tip 149 presses against the nearest rim 150 of adjoining spool 152 so as to force spool 152 against spool 154 and so on until the spools are pressed against the ring 76 adjoining wall 16 as illustrated in FIGS. 2 and 3. Pivot 156 is not secured with the crossbar and slot shown in FIG. 3.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims. For example, the sales stand for the chains or other materials can be made with just a single row of spools or even three or more rows of spools, all employing the same system for locking the spools of each row.

I claim:

1. A system for locking spools for chains on display, comprising, in combination, at least one generally horizontal spool member including a cylindrical portion having opposed first and second axial spool ends and forming a cylindrical axial hole extending between said opposed first and second axial ends and a pair of opposed radially extending rims connected to said cylindrical portion, an elongated chain spooled around said cylindrical portion between said rims, an elongated cylindrical pivot member having opposed first and second pivot ends and extending through said axial spool hole beyond said first and second spool ends, respectively, said first pivot end having external threads, first and second support means located proximate each of said first and second pivot ends, respectively, for supporting said pivot member, said support means including a pair of generally parallel spaced generally vertical first and second walls having facing surfaces and a pair of opposed first and second brackets secured to said first and second walls, respectively, at said facing surfaces, each said bracket forming a generally semicylindrical bottom portion supporting said first and second pivot ends, said second pivot end being nonrotatably positioned at said second bracket, locking means mounted to said first bracket and threadably connected to said pivot member for moving said one spool member between a first spooling mode and a second nonspooling mode wherein in said second nonspooling mode said one spool member is held in a frictional locking relationship between said means for locking and said second support means whereby said chain cannot be unspooled from said one spool member; said locking means being releasable from holding said one spool member in said nonspooling mode so that said one spool member is in a spooling mode wherein said one spool member is positioned in a nonfrictional, nonlocking relationship between said means for locking and said second support means, whereby said chain can be unspooled from said one spool member; said locking means including a cylindrical locking member having opposed inner and outer axial ends and an axial pocket having internal threads at said inner axial end, said first pivot end of said pivot member being threadably mounted in said pocket, said locking member being capable of being threaded onto said pivot member toward said first axial spool end and from said pivot member away from said first axial spool end, said outer axial end having keyway means, first pressure means positioned between said inner axial end of said locking member and said first axial spool end of said spool member, and second pressure means positioned between said second axial end of said pivot member and said second bracket means, said locking member pressuring said first pressure means against said first axial spool end and pressuring said second pressure means said second bracket means during movement from said first spooling to said second nonspooling positions, and locking tool means for rotating said locking member between said first and second positions in response to operation by a user, said locking tool means having key means for fitting into said keyway means, said locking tool means being removably mounted to said locking member at said keyway means during rotation of said locking member so as to threadably and axially move said locking member relative to said pivot member between said first and second positions, said first wall having opposed inner and outer surfaces and having an aperture extending between said inner and outer surfaces, said outer axial end of said locking member being spaced proximate said inner surface in alignment with said aperture, said tool means having a handle portion positioned away from said outer surface and a tool portion including said key means being extendable through said aperture and removably connected to said keyway means of said locking member at said outer axial end, whereby said locking member can be rotated by way of said handle portion.

2. The system according to claim 1, wherein said first and second pressure means includes first and second flat rings positioned on said pivot member and further including first and second detent, said first detent being positioned between said inner axial end of said locking member and said first rim and said second detent being positioned proximate to said second pivot end, said first and second detents being adapted to prevent said first and second rings respectively from being moved when said spool member is in said nonspooling mode.

3. The system according to claim 2, wherein said pivot member has a first diameter and said locking member has a second diameter greater than said first diameter, said inner axial end of said locking member forming a first circular blocking surface forming said first detent, and wherein said second pivot end has a third diameter approximately equal to said first diameter, said pivot member and said raised portion forming a circular blocking surface forming said second detent.

4. The system according to claim 3, further including means for preventing said pivot member from being lifted from said first and second brackets, said means for preventing being a locking crossbar removably connected to said second bracket across said top portion thereof over said pivot member.

5. The system according to claim 4, wherein said at least one spool member is a plurality of spool members, including a first spool member and a last spool member rotatably mounted on said pivot member, said second rim being the rim of said last spool member adjacent to said second bracket.

6. The system in accordance with claim 1, wherein said tool means is an hexagonal wrench.

7. The system in accordance with claim 6, further including gripping means for preventing said pivot member from rotating, said gripping means including a crossbar disposed across said second bracket, said second pivot end of said pivot member forming a diametrical slot adapted to receive said crossbar wherein said pivot member is prevented from rotating when said locking member is being threaded onto or from said pivot member.

8. A system for locking spools for chains on display, comprising, in combination, at least one generally horizontal spool member including a cylindrical portion having opposed first and second axial spool ends and forming a cylindrical axial hole extending between said opposed first and second axial ends and a pair of opposed radially extending rims connected to said cylindrical portion, an elongated chain spooled around said cylindrical portion between said rims, an elongated cylindrical pivot member having opposed first and second pivot ends and extending through said axial spool hole beyond said first and second spool ends, respectively, said spool member being rotatable about said second pivot member, said first pivot end having external threads, first and second support means located proximate each of said first and second pivot ends, respectively, for supporting said pivot member, said support means including a pair of generally parallel spaced generally vertical first and second walls having facing surfaces and a pair of opposed first and second brackets secured to said first and second walls, respectively, at said facing surfaces, each said bracket forming a generally semicylindrical bottom portion supporting said first and second pivot ends, said second pivot end being nonrotatable positioned at said second bracket, locking means mounted to said first bracket and threadably connected to said pivot member for moving said one spool member between a first spooling mode and a second nonspooling mode wherein in said second nonspooling mode said one spool member is held in a frictional locking relationship between said means for locking and said second support means whereby said chain cannot be unspooled from said one spool member; said locking means being releasable from holding said one spool member in said nonspooling mode so that said one spool member is in a spooling mode wherein said one spool member is positioned in a nonfrictional, nonlocking relationship between said means for locking and said second support means, whereby said chain can be unspooled from said one spool member; said locking means including a cylindrical locking member having opposed inner and outer axial ends and an axial pocket having internal threads at said inner axial end, said first pivot end of said pivot member being threadably mounted in said pocket, said locking member being capable of being threaded onto said pivot member toward said first axial spool end and from said pivot member away from said first axial spool end, said outer axial end having keyway means, first pressure means positioned between said inner axial end of said locking member and said first axial spool end of said spool member, and second pressure means positioned between said second axial end of said pivot member and said second bracket means, said locking member pressuring said first pressure means against said first axial spool end and pressuring said second pressure means said second bracket means during movement from said first spooling to said second nonspooling positions, and locking tool means for rotating said locking member between said first and second positions in response to operation by a user, said locking tool means including key means for fitting into said keyway means, said locking tool means being removably mounted to said locking member at said keyway means during rotation of said locking member so as to threadably and axially move said locking member relative said pivot member between said first and second positions, said first wall having opposed inner and outer surfaces and having an aperture extending between said inner and outer surfaces, said outer axial end of said locking member extending through said aperture to a position spaced from said outer surface, said tool means including a cylindrical handle axially aligned with and connected to said locking member at said outer axial end, whereby said locking member can be rotated by way of said cylindrical handle.

* * * * *